US012075849B2

(12) United States Patent
Shimizu

(10) Patent No.: US 12,075,849 B2
(45) Date of Patent: Sep. 3, 2024

(54) METHOD OF MOUNTING TOBACCO LEAVES FOR HEATED TOBACCO PRODUCT

(71) Applicant: Intellectual Discovery Co., Ltd., Seoul (KR)

(72) Inventor: Kazuhiko Shimizu, Hyogo (JP)

(73) Assignee: Intellectual Discovery Co., Ltd. (KR)

( * ) Notice: Subject to any disclaimer, the term of this patent is extended or adjusted under 35 U.S.C. 154(b) by 198 days.

(21) Appl. No.: 16/845,561

(22) Filed: Apr. 10, 2020

(65) Prior Publication Data

US 2020/0329778 A1 Oct. 22, 2020

(30) Foreign Application Priority Data

Apr. 11, 2019 (JP) ..... 2019-075239

(51) Int. Cl.
*A24F 40/42* (2020.01)
*A24F 40/20* (2020.01)
*A24F 42/60* (2020.01)

(52) U.S. Cl.
CPC ..... *A24F 42/60* (2020.01); *A24F 40/20* (2020.01); *A24F 40/42* (2020.01)

(58) Field of Classification Search
CPC ..... A24F 40/20; A24F 40/42
USPC ..... 131/329
See application file for complete search history.

(56) References Cited

U.S. PATENT DOCUMENTS 62,802 A * 3/1867 Andrews ..... A24F 1/28 131/191
1,730,033 A * 10/1929 Faranda ..... A24F 13/14 131/175
2,024,865 A * 12/1935 McArdle ..... A24F 1/08 131/222
5,726,421 A * 3/1998 Fleischhauer ..... A24F 40/40 131/194
8,897,628 B2 * 11/2014 Conley ..... A24F 40/42 392/386
10,064,434 B2 * 9/2018 Zitzke ..... A61M 11/042
10,104,909 B2 * 10/2018 Han ..... H05B 3/46
10,602,774 B2 3/2020 Hawes et al.
(Continued)

FOREIGN PATENT DOCUMENTS

JP 3392138 B2 3/2003
JP 5272200 B2 8/2013
(Continued)

*Primary Examiner* — Russell E Sparks
(74) *Attorney, Agent, or Firm* — The Belles Group, P.C.

(57) ABSTRACT

A smoking jig using a pot-type heating method is provided. After smoking by putting tobacco leaves into the smoking jig, a user may remove tobacco leaves remaining after finishing smoking and put the tobacco leaves to an ashtray by performing an operation called "Shag-Pon." However, in the case of a smoking jig using a pin-type heating method, a user cannot discard the tobacco leaves remaining after finishing smoking to an ashtray after smoking by putting tobacco leaves into the smoking jig. Accordingly, a notch is formed at a part of a tobacco leaf insertion tube so that pellet-shaped tobacco leaves are placed into the notch. As a result, a user may pull both a mouthpiece and the tobacco leaf insertion tube out of the smoking jig and remove the tobacco leaves remaining after finishing smoking from the notch and put the tobacco leaves to an ashtray.

10 Claims, 2 Drawing Sheets

(56) References Cited

U.S. PATENT DOCUMENTS

| | | | | |
|---|---|---|---|---|
| 10,918,136 | B2 * | 2/2021 | Reevell | H05B 1/0244 |
| 11,229,235 | B2 * | 1/2022 | Saygili | A24F 40/485 |
| 11,653,699 | B2 * | 5/2023 | Blattler | A24F 40/485 131/273 |
| 2013/0014772 | A1 | 1/2013 | Liu | |
| 2014/0013126 | A1 | 1/2014 | Allen-Ware et al. | |
| 2015/0296887 | A1 | 10/2015 | Zhu | |
| 2016/0073694 | A1 | 3/2016 | Liu | |
| 2016/0135504 | A1 | 5/2016 | Li et al. | |
| 2016/0192709 | A1 | 7/2016 | Liu | |
| 2016/0227841 | A1 | 8/2016 | Li et al. | |
| 2016/0249683 | A1 | 9/2016 | Li et al. | |
| 2016/0324216 | A1 | 11/2016 | Li et al. | |
| 2016/0345630 | A1 | 12/2016 | Mironov | |
| 2016/0353805 | A1 | 12/2016 | Hawes et al. | |
| 2017/0071251 | A1 | 3/2017 | Goch | |
| 2017/0202265 | A1 | 7/2017 | Hawes et al. | |
| 2017/0347706 | A1 | 12/2017 | Aoun et al. | |
| 2018/0169357 | A1 | 6/2018 | Reevell | |
| 2018/0360122 | A1 | 12/2018 | Aoun et al. | |
| 2020/0275694 | A1 | 9/2020 | Hawes et al. | |
| 2020/0297029 | A1 | 9/2020 | Shimizu | |
| 2020/0359688 | A1 * | 11/2020 | Jang | A24D 1/20 |
| 2020/0375249 | A1 | 12/2020 | Yanez | |
| 2021/0106051 | A1 * | 4/2021 | Han | A24F 40/50 |
| 2021/0235770 | A1 * | 8/2021 | Uthurry | H05B 1/0297 |
| 2021/0361890 | A1 | 11/2021 | Li et al. | |
| 2022/0007721 | A1 | 1/2022 | Aoun et al. | |

FOREIGN PATENT DOCUMENTS

| | | | |
|---|---|---|---|
| JP | 2013150593 | A | 8/2013 |
| JP | 2014117247 | A | 6/2014 |
| JP | 5854394 | B2 | 2/2016 |
| JP | 2017511703 | A | 4/2017 |
| JP | 2017127300 | A | 7/2017 |
| JP | 2018516551 | A | 6/2018 |
| JP | 2018174802 | A | 11/2018 |
| JP | 2018174880 | A | 11/2018 |
| JP | 2019041736 | A | 3/2019 |
| JP | 2019041736 | A1 | 3/2019 |
| KR | 20-0189244 | Y1 | 7/2000 |
| KR | 20090100400 | A1 | 9/2009 |
| KR | 20120051570 | A | 5/2012 |
| KR | 20130008957 | A | 1/2013 |
| KR | 20160031801 | A | 3/2016 |
| KR | 20170128354 | A | 11/2017 |
| KR | 20180005212 | A | 1/2018 |
| KR | 10-2018-0085365 | A | 7/2018 |
| KR | 20-01892442 | Y1 | 7/2020 |
| WO | WO2014020953 | A1 | 2/2014 |
| WO | WO2016062777 | A1 | 4/2016 |
| WO | WO2016070553 | A1 | 5/2016 |
| WO | WO2016179376 | A1 | 11/2016 |
| WO | WO2017141017 | A1 | 8/2017 |
| WO | WO2018/114263 | A1 | 6/2018 |
| WO | WO2018114312 | A | 6/2018 |
| WO | WO2018189195 | A1 | 10/2018 |
| WO | WO2018224677 | A2 | 12/2018 |

* cited by examiner

METHOD OF MOUNTING TOBACCO LEAVES FOR HEATED TOBACCO PRODUCT

CROSS-REFERENCE TO RELATED APPLICATIONS

This application claims priority to and the benefit of Japanese Patent Application No. 2019-075239 filed in the Japanese Intellectual Property Office on Apr. 11, 2019, the entire contents of which are incorporated herein by reference.

TECHNICAL FIELD

The present invention relates to a method of mounting tobacco leaves for a smoking jig, which inserts tobacco leaves (tobacco leaves for a heated tobacco product, tobacco leaves for a cigarette that allows a user to smoke by burning the tobacco leaves, tobacco leaves for a cigarette rolled by hand, or tobacco leaves for a cigar) into the smoking jig, and heats the inserted tobacco leaves with a heater, thereby enabling the user to inhale nicotine or tobacco flavor evaporated from the tobacco leaves.

BACKGROUND ART

In general, a smoking jig called a vaporizer is used by putting tobacco leaves into a heating tube, mounting a mouthpiece called a drip tip, thereby allowing a user to inhale, from the drip tip, nicotine or tobacco flavour generated by heating the tobacco leaves. The smoke jig is a popular product because the cost required for smoking is lower than the cost incurred by heated tobacco products such as IQOS™, glo™, and Ploom S™ or a cigarette that allows a user to smoke by burning the tobacco leaves. Methods of heating the inserted tobacco leaves are broadly classified into two methods including a pot-type heating method which puts tobacco leaves into a pot and heats the tobacco leaves with a heater from the outside of the pot, and a pin-type heating method which inserts a plate-shaped or pin-shaped heater almost at a center of the inserted tobacco leaves and heats the tobacco leaves. The pot-type heating method requires high power consumption, requires a thermal insulator disposed around the heater to prevent the outside of the jig from getting hot, and uses a big jig.

On the other hand, the pin-type heating method requires low power consumption because the inserted tobacco leaves are heated from a center thereof. The pin-type heating method may reduce the size of a rechargeable battery for driving because the outside of the jig is not very hot even though there is no thermal insulator. Further, in the pin-type heating method, compact jigs are often used.

However, the vaporizer, which uses the pin-type heating method, is disadvantageous in that the tobacco leaves cannot be simply removed after smoking. Therefore, the vaporizers mostly use the pot-type heating method. That is, in the case of the jig using the pot-type heating method, the tobacco leaves are simply withdrawn by removing the drip tip and hitting the jig after smoking. Alternatively, in a case in which a user smokes by putting tobacco leaves into a metallic tube (generally, called a spacer) and inserting the spacer into a pot, the user may more simply take out the spacer (tobacco leaves). In general, the tobacco leaves may be simply taken out by an operation called "Shag-Pon". Meanwhile, in the case of the vaporizer using the pin-type heating method, because the heater is inserted almost at the center of the inserted tobacco leaves, the tobacco leaves do not come out of the jig even though the jig is hit because of friction between the heater and the tobacco leaves. For this reason, the power consumption may be low and the jig may be compact, but the vaporizer using the pin-type heating method seems to be less commercialized.

SUMMARY OF THE INVENTION

The present invention is made by developing and commercializing the smoking jigs, but users are still of the opinion that it is difficult to use the smoking jig without using the "Shag-Pon". Accordingly, the present invention provides a vaporizer which is a smoking jig using a pin-type heating method and is improved to enable the "Shag-Pon".

DETAILED DESCRIPTION

Figure 3:
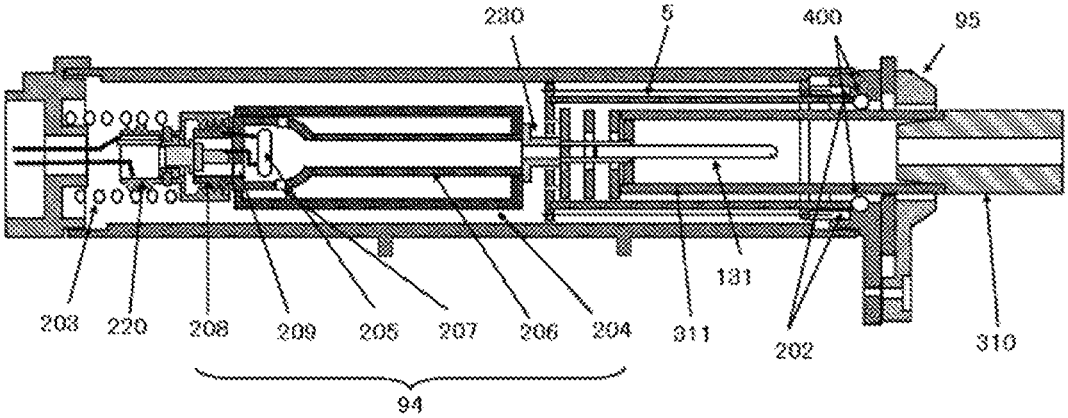
FIG. 3 is an axial cross-sectional view of a smoking jig in a state in which a tobacco leaf introducing tube and a mouthpiece are inserted.

FIG. 3 is an axial cross-sectional view of a smokeless smoking jig. The smokeless smoking jig includes: an atomizer 94, a spring 203 configured to tightly push the atomizer 94 against a heating tube, a 510 connector 220 configured to supply electric power to the atomizer 94, a bushing 230 (changed to silicone having a hole disposed between the atomizer 94 and the heating tube, an inner tube 5 constituting the heating tube, an O-ring 400, a connector 202, a tobacco retaining part (B) 95, a mouthpiece 310, and a tobacco leaf insertion tube 311.

Figure 4:
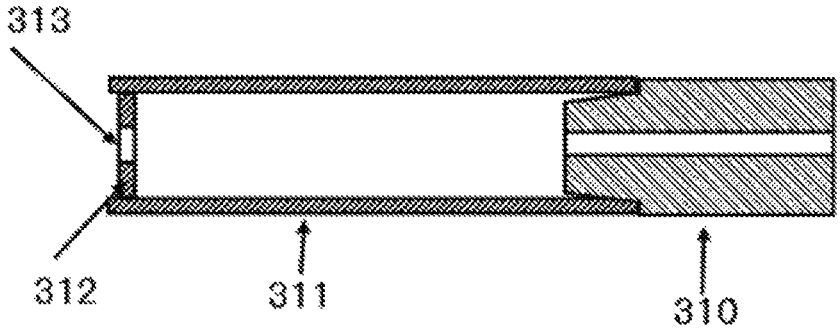
FIG. 4 is an axial cross-sectional view illustrating the tobacco leaf introducing tube and the mouthpiece.

The atomizer 94 includes a container 204 configured to receive a liquid, an inner tube 206, a heater 205, a hole 207 configured to supply a liquid to the heater, an air intake 209, and a 510 connector. A detailed description thereof will be omitted. FIG. 4 is an axial cross-sectional view illustrating a mouthpiece 310 and a tobacco leaf introducing tube 311. A tip portion 312 of the tobacco leaf introducing tube 311 is made by drawing the tobacco leaf introducing tube or made by fitting a washer or bushing made of metal or heat-resistant resin. Furthermore, a hole 313 through which the heater passes is formed almost at a center.

As illustrated in FIG. 3, a smoker puts tobacco leaves into the tobacco leaf introducing tube 311, mounts the mouthpiece, and then inserts the tobacco leaf introducing tube 311 into the smoking jig. With this insertion, the heater 131 is inserted almost at a center of the inserted tobacco leaves (not illustrated), thereby efficiently heating the tobacco leaves. After smoking, the tobacco leaf introducing tube attached with the mouthpiece is withdrawn from the smoking jig, the mouthpiece is detached, and the tobacco leaves, which have been completely used to smoke, in the tobacco leaf introducing tube are discarded. In this case, because the tobacco leaf introducing tube becomes hot by being heated, the user is inconvenienced because the user cannot detach the mouthpiece until the tobacco leaf introducing tube is cooled.

Figure 1:
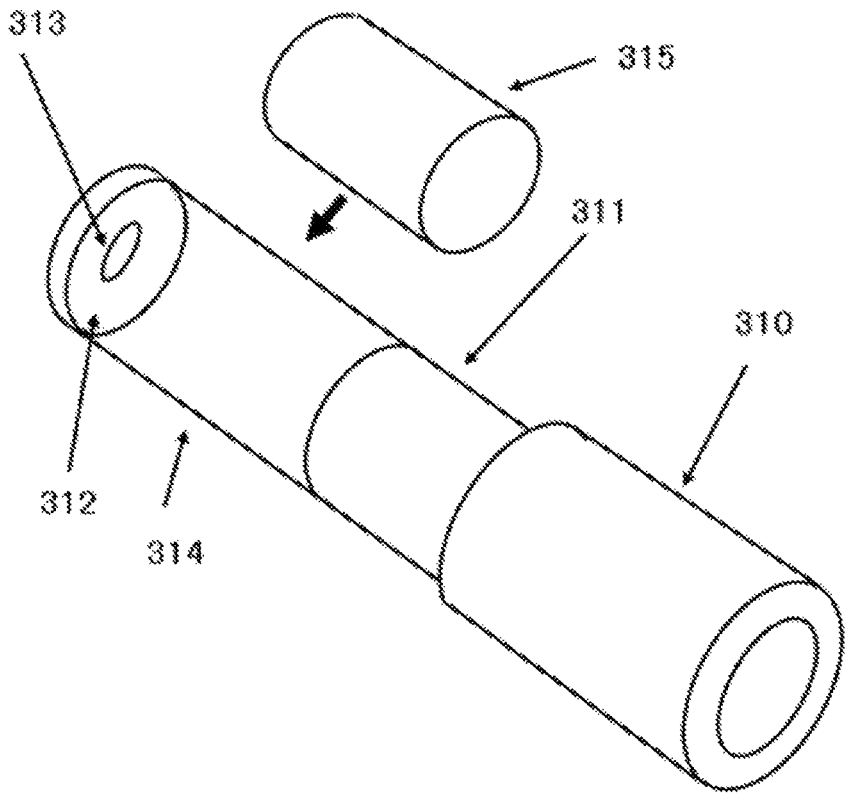
FIG. 1 is an outline view illustrating a tobacco leaf introducing tube and a mouthpiece which are improved according to the present invention.
Figure 2:
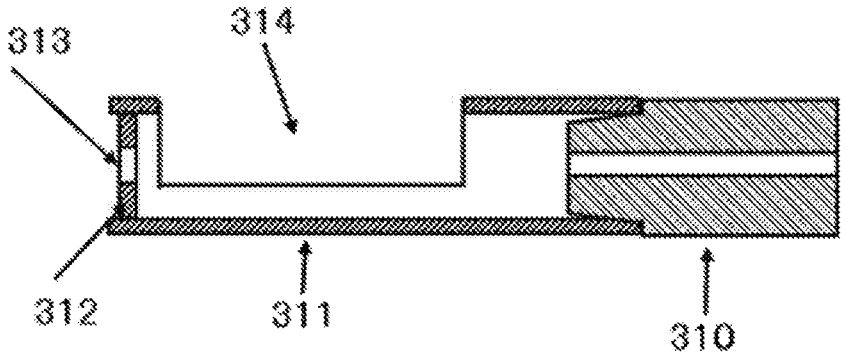
FIG. 2 is an axial cross-sectional view illustrating the tobacco leaf introducing tube and the mouthpiece illustrated in FIG. 1.

Therefore, in order to avoid the inconvenience, the present inventor forms a notch 314 at a part of the tobacco leaf introducing tube 311, as illustrated in FIGS. 1 and 2. This configuration will be described in more detail with reference to an outline view of FIG. 1. The tobacco leaf insertion tube 311 may have any dimensions as long as the tobacco leaf insertion tube 311 has a thickness of 0.1 mm to 0.5 mm, and an inner diameter of about 7.7 mm to about 9.0 mm. However, the tobacco leaf insertion tube 311 needs to have an inner diameter of 8.9±0.1 mm so as to be fitted with a drip tip used as the mouthpiece 310. An AL tube having a thickness of 0.25 mm and an inner diameter of 8.9 mm, as actual dimensions, is used. The tip portion 312 is formed by drawing processing. The drawing processing uses a pipe cutter having a rotary blade having slightly reduced cutting properties and cuts the AL tube, such that the AL tube may have a portion having a small thickness and have a portion cut inward by being drawn when cutting the AL tube. It could be seen that by cutting and drawing the AL tube inward by using the above-mentioned process method and by inserting a circular spacer or bushing, which is made of metal or heat-resistant resin and has a diameter equal to the inner diameter of the AL tube, into the mouthpiece and then pushing the circular spacer or bushing inward, the circular space or bushing may be fixed to the tip portion 312. Alternatively, the tip portion of the AL tube may be formed by the drawing processing. As illustrated, the notch 314 having a half or more of a length 10 mm to 15 mm is formed, by a laser, a grinder, or the like, in the tobacco leaf insertion tube 311 made as described above. The mouthpiece 310 is inserted into the tobacco leaf insertion tube 311 having the tip portion 312 and the notch 314. A spacer filled with tobacco leaves, a cut cigarette, or a cylindrical pellet made by compressing tobacco leaves, which is denoted by 315, is put into the notch 314, the tobacco leaf insertion tube is inserted into the smoking jig from the tobacco retaining part (B) 95, and the tobacco leaves are heated by the heater 131, such that the user smokes. After smoking, the tobacco leaf insertion tube 311 is taken out together with the mouthpiece 310, and various types of tobacco leaves denoted by reference numeral 315 may be discarded into an ashtray or the like. In this case, since the user does not touch the hot tobacco leaf insertion tube 311 with his/her hand, there is no risk that the user may be burned.

In the present application, the cylindrical tobacco leaves are inserted, but the present invention is not limited to the shape of the tobacco leaves but can be applied to tobacco leaves having any shape.

INDUSTRIAL APPLICABILITY

After the user smokes by putting the tobacco leaves into the smoking jig using the pin-type heating method that heats the tobacco leaves with the plate-shaped or pin-shaped heater, the user may simply take out the tobacco leaves remaining after finishing smoking and discard the tobacco leaves to an ashtray or the like. That is, a part of the tobacco leaf insertion tube has the notch into which tobacco leaves are to be inserted, and the user smokes by putting pellet-shaped tobacco leaves into the notch and then inserting the tobacco leaf insertion tube integrated with the mouthpiece into the smoking jig. After smoking, the user may pull out both the mouthpiece and the tobacco leaf insertion tube and take out the tobacco leaves remaining after finishing smoking from the notch and put the tobacco leaves to the ashtray or the like, such that the user may perform the Shag-Pon even with the smoking jig using the pin-type heating method.

What is claimed is:

1. A smoking jig device, comprising:

a cigarette introducing tube comprising:

a mouthpiece which is detachably connected at a second end of the cigarette introducing tube opposite a first end of the cigarette introducing tube; and a first hole disposed at the first end of the cigarette introducing tube;

a heating tube comprising:

an elongated cavity into which at least a part of the cigarette introducing tube at the first end is received; and a first heater, the first heater configured at least to:

extend into the cigarette introducing tube via the first hole to be in direct heating contact with a user-added content of the cigarette introducing tube; and heat the content of the cigarette introducing tube;

an atomizer connected to the heating tube with a silicone bushing; and a spring configured to press the atomizer against the heating tube, wherein the atomizer comprises at least:

a container configured to receive a liquid;

an inner tube disposed in the container;

a second heater disposed in the inner tube; and a second hole disposed in the inner tube through which the liquid flows to supply the second heater.

2. The smoking jig device of claim 1, wherein the cigarette introducing tube further comprises at least one of: a bushing or a circular spacer which is provided at the first end of the cigarette introducing tube, and wherein the first hole is formed at the at least one of: the bushing or the circular spacer.

3. The smoking jig device of claim 1, wherein the atomizer further comprises an air intake.

4. The smoking jig device of claim 1, further comprising a connector configured to supply electric power to the atomizer.

5. The smoking jig device of claim 1, further comprising an O-ring configured to provide a seal between the cigarette introducing tube and the heating tube.

6. A method of providing a smoking jig device, the method comprising:

providing a cigarette introducing tube;

providing a mouthpiece which is detachably connected at a second end of the cigarette introducing tube opposite a first end of the cigarette introducing tube;

configuring a first hole at the first end of the cigarette introducing tube;

providing a heating tube comprising an elongated cavity into which at least a part of the cigarette introducing tube at the first end is received;

providing a first heater as part of the heating tube such that the first heater extends into the cigarette holding tube via the first hole to be in direct heating contact with a user-added content of the cigarette introducing tube and the first heater heats the content of the cigarette introducing tube;

connecting an atomizer to the heating tube with a silicone bushing;

disposing a spring configured to press the atomizer against the heating tube;

disposing a container in the atomizer, the container configured to receive a liquid;

disposing an inner tube within the container;

disposing a second heater in the inner tube; and configuring a second hole in the inner tube, the second hole providing an opening via which the liquid flows to supply the second heater.

7. The method of claim 6, further comprising:

providing at least one of: a bushing or a circular spacer at the first end of the cigarette introducing tube; and forming the first hole at the at least one of: the bushing or the circular spacer.

8. The method of claim 6, further comprising disposing an air intake in the atomizer.

9. The method of claim 6, further comprising providing a connector to supply electric power to the atomizer.

10. The method of claim 6, further comprising providing an O-ring to provide a seal between the cigarette introducing tube and the heating tube.

* * * * *